US008091988B2

(12) United States Patent
McDonald

(10) Patent No.: US 8,091,988 B2
(45) Date of Patent: Jan. 10, 2012

(54) CAVITY PLATE

(75) Inventor: Marlene McDonald, Norwich, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 217 days.

(21) Appl. No.: 12/125,648

(22) Filed: May 22, 2008

(65) Prior Publication Data

US 2009/0290000 A1 Nov. 26, 2009

(51) Int. Cl.
*B41J 2/05* (2006.01)

(52) U.S. Cl. ..... 347/65

(58) Field of Classification Search ..... 347/71
See application file for complete search history.

(56) References Cited

U.S. PATENT DOCUMENTS

| | | | | |
|---|---|---|---|---|
| 7,673,974 | B2 * | 3/2010 | Takahashi et al. | 347/68 |
| 2001/0020968 | A1 | 9/2001 | Isono et al. | |

FOREIGN PATENT DOCUMENTS

| | | |
|---|---|---|
| JP | 2000-190498 | 7/2000 |
| JP | 2002-225267 | 8/2002 |
| JP | 2004-291479 | 10/2004 |
| JP | 2008-036890 | 2/2008 |

OTHER PUBLICATIONS

International Search Report from PCT/US2009/043290 dated Nov. 27, 2009.
U.S. Appl. No. 09/749,893, filed Dec. 29, 2000, Palifka et al.
Search Report dated Apr. 20, 2011 received in European application No. 09751154.7, 3 pgs.
International Preliminary Report on Patentability dated Dec. 2, 2010 issued in international application No. PCT/US2009/043290, 7 pgs.
Office action dated Jun. 21, 2011 issued in European application No. 09751154.7, 6 pgs.

* cited by examiner

*Primary Examiner* — Matthew Luu
*Assistant Examiner* — Lisa M Solomon
(74) *Attorney, Agent, or Firm* — Fish & Richardson P.C.

(57) ABSTRACT

Among other things, a cavity plate for use in ink jetting includes an outlet end. Elongated lands extend from the outlet end toward an inlet end of the cavity plate. The elongated lands have side walls between top and bottom surfaces of the cavity plate to form elongated cavities. There are structural supports upstream of the ink outlets and between the elongated lands, to support the elongated lands.

21 Claims, 9 Drawing Sheets

CAVITY PLATE

TECHNICAL FIELD

This description relates to a cavity plate.

BACKGROUND

Cavity plate can form a part of an ink jetting device that jets ink.

SUMMARY

In general, in an aspect, a cavity plate for use in ink jetting includes an outlet end. Elongated lands extend from the outlet end toward an inlet end of the cavity plate. The elongated lands have side walls between top and bottom surfaces of the cavity plate to form elongated cavities. There are structural supports upstream of the ink outlet end and between the elongated lands, to support the elongated lands.

Implementations may include one or more of the following features.

The structural supports that are between the elongated lands are located downstream of the inlet end of the cavity plate. The structural supports that are between the elongated lands are located at the inlet end. Some of the structural supports that are between the elongated lands are located at the inlet end of the cavity plate and some of the structural supports that are between the elongated lands are located downstream of the inlet end. The structural supports that are between the elongated lands are located midway between the inlet end and the outlet end. Each of the structural supports connects one land to an adjacent land. The cavity has a depth between the top and bottom surfaces, and each of the structural supports has a thickness less than the depth of the cavity. The cavity has a depth between the top and bottom surfaces, and each of the structural supports has a thickness less than half of the depth of the cavity. Each of the structural supports has a surface in the same plane as one of the surfaces of the cavity plate. The structural supports are perpendicular to the lands. The side walls are etched. The structural supports are integral with the lands. There are covers on the top and bottom surfaces to enclose the cavities to form pumping chambers. Piezoelectric elements are positioned to pump ink from the cavities through the ink outlet end.

In general, in another aspect, a cavity plate for use in ink jetting is made by forming, with the plate, elongated lands, elongated cavities between the lands, and support structures that are between the lands and configured to permit ink to flow along the cavities past the support structures.

Implementations include one or more of the following features.

The forming comprises etching. The etching is done differently at the locations of the support structures than at other locations. The etching is done differently by etching from only one surface of the plate at the locations of the support structures and from both surfaces of the plate at other locations. Covers are attached to each surface of the cavity plate to form pumping chambers. The covers include polymer films. The covers include stiffener plates.

In general, in another aspect, an orifice plate for use in ink jetting includes an upper surface and a lower surface. The upper surface includes two rows of openings to receive ink jetted from ink pumping chambers and the lower surface includes one row of openings to jet ink out from the orifice plate onto a substrate.

Implementations include one or more of the following features.

The two rows of openings on the upper surface of the orifice plate are parallel along a long dimension of the orifice plate. The openings in the two rows are equal distanced along the long dimension of the orifice plate. The openings in one of the two rows are staggered with respect to the openings in the other row along the long dimension. Each opening in the two rows in the upper surface of the orifice plate is connected to one opening in the lower surface through a channel. Each channel tapers from the opening in the upper surface towards the opening in the lower surface. The openings in the lower surface of the orifice plate are equal distanced. The openings in the lower surface of the orifice plate are connected to the openings in the two rows in the upper surface alternatively. Each opening in the lower surface is square shaped. Each opening in the lower surface is an orifice. The orifice plate includes silicon. The openings in the upper and lower surfaces and the channels are etched.

These and other aspects and features can be expressed as methods, apparatus, systems, means for performing a function, and in other ways.

Other features and advantages will be apparent from the following detailed description, and from the claims.

DESCRIPTION

Figure 2:
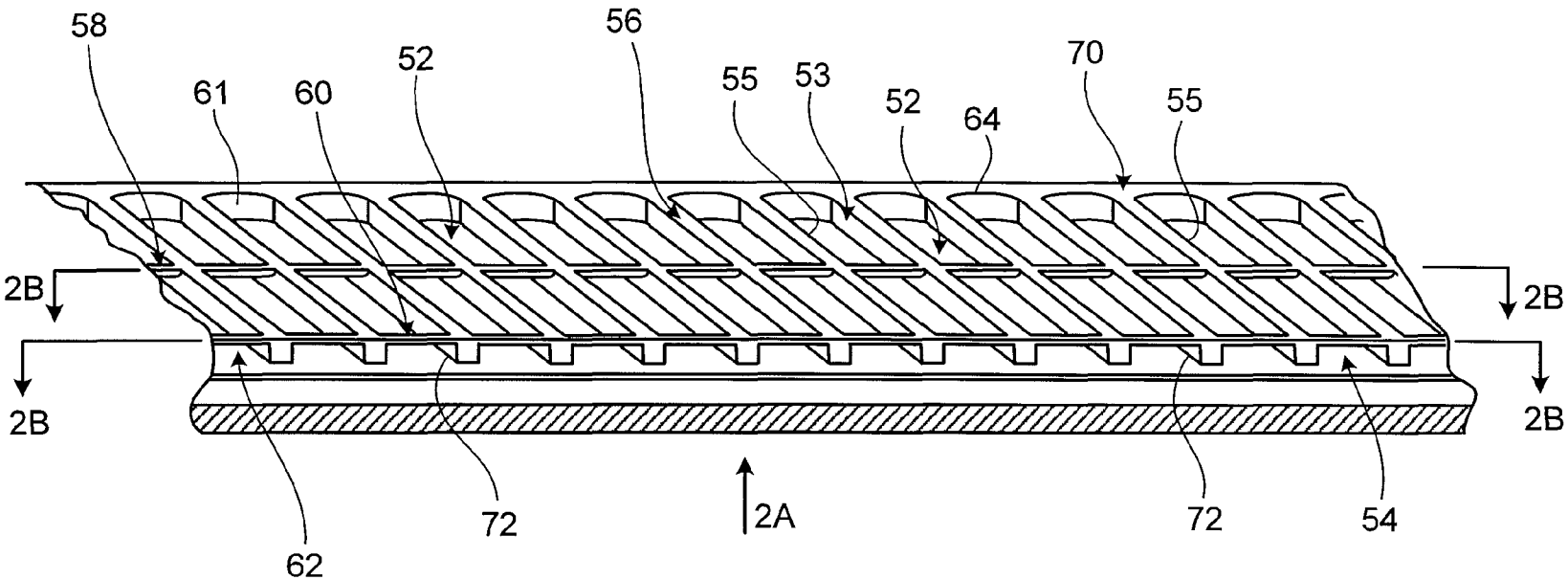
Figure 2A:
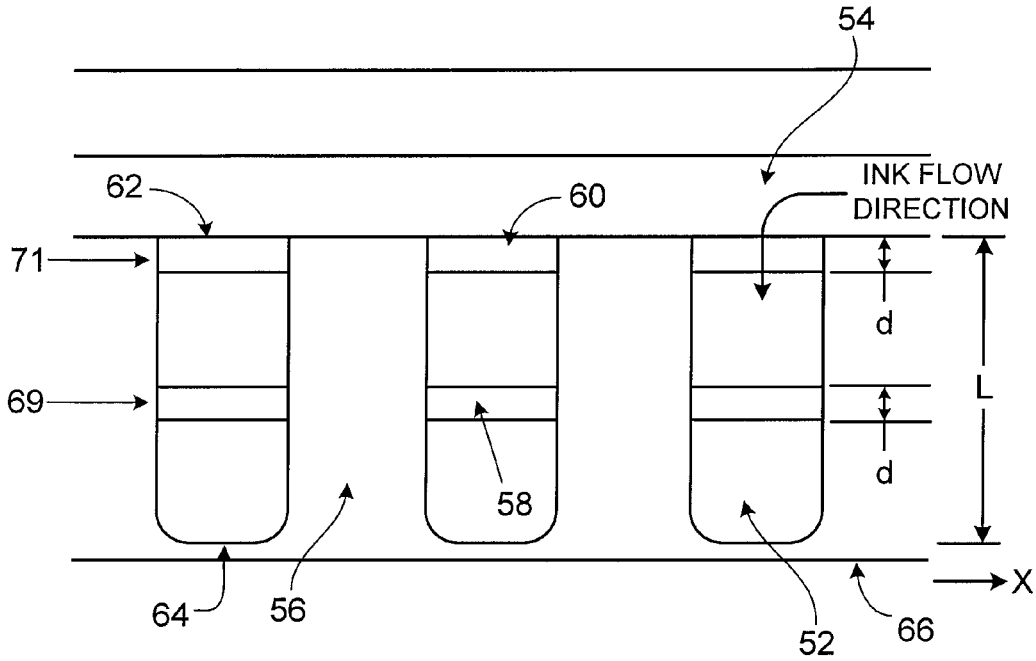
Figure 2B:
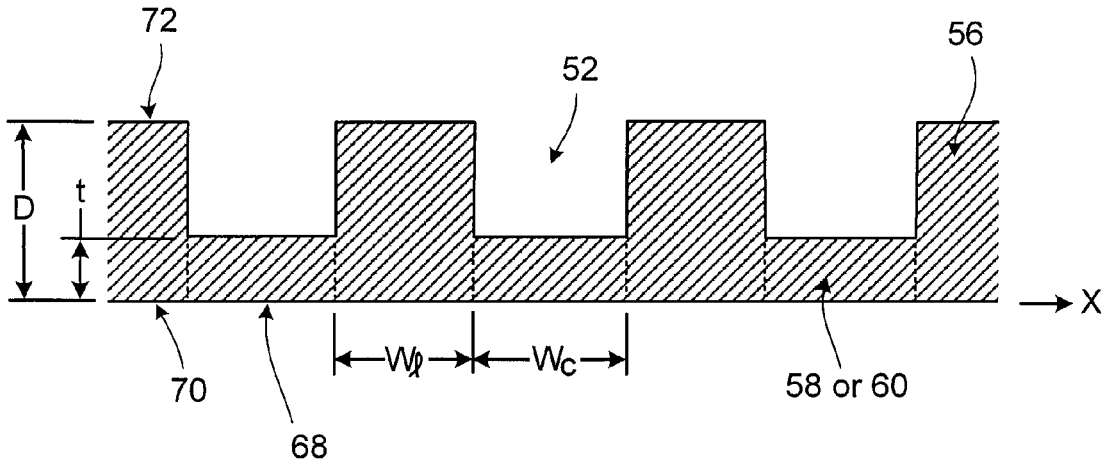

FIGS. 2, 2A, and 2B are a perspective view, a top view, and a cross-sectional view of cavity plates (not to scale).

Figure 3A:
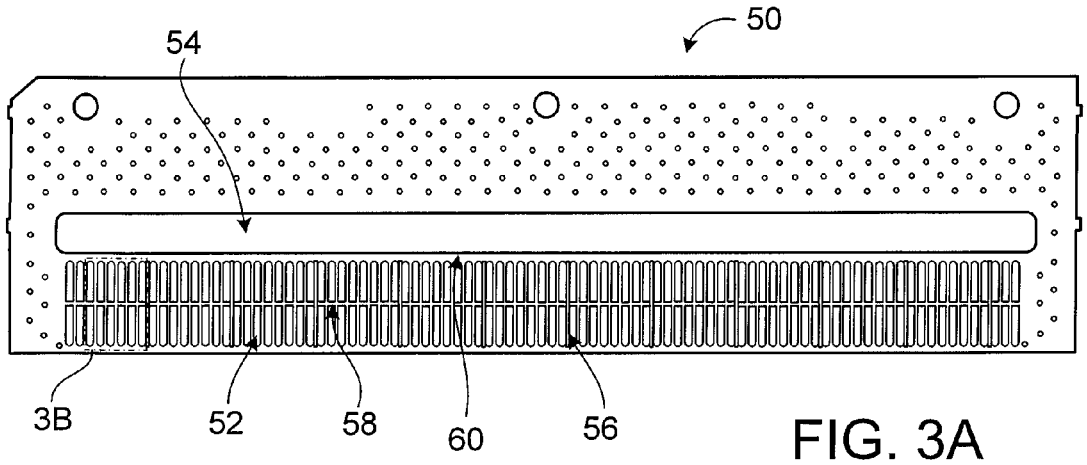
Figure 3B:
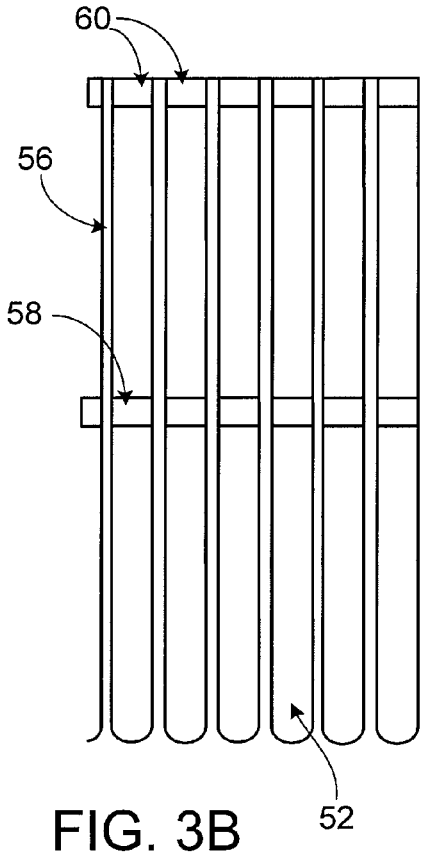

FIGS. 3A and 3B are an enlarged top view and an enlarged top view of cavity plates to scale.

Figure 4:
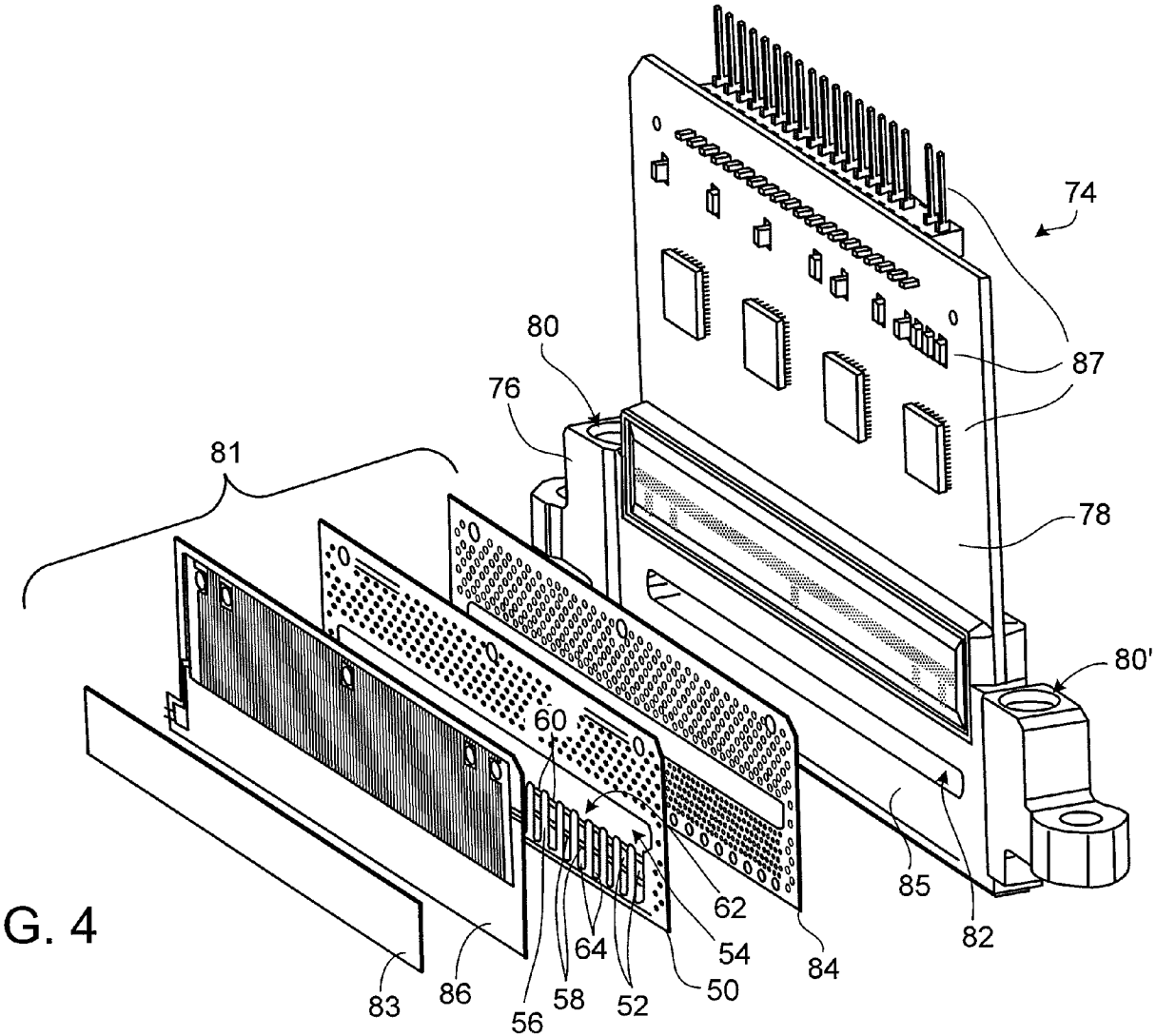

FIG. 4 is an exploded perspective view of an ink jetting assembly (not to scale).

Figure 4A:
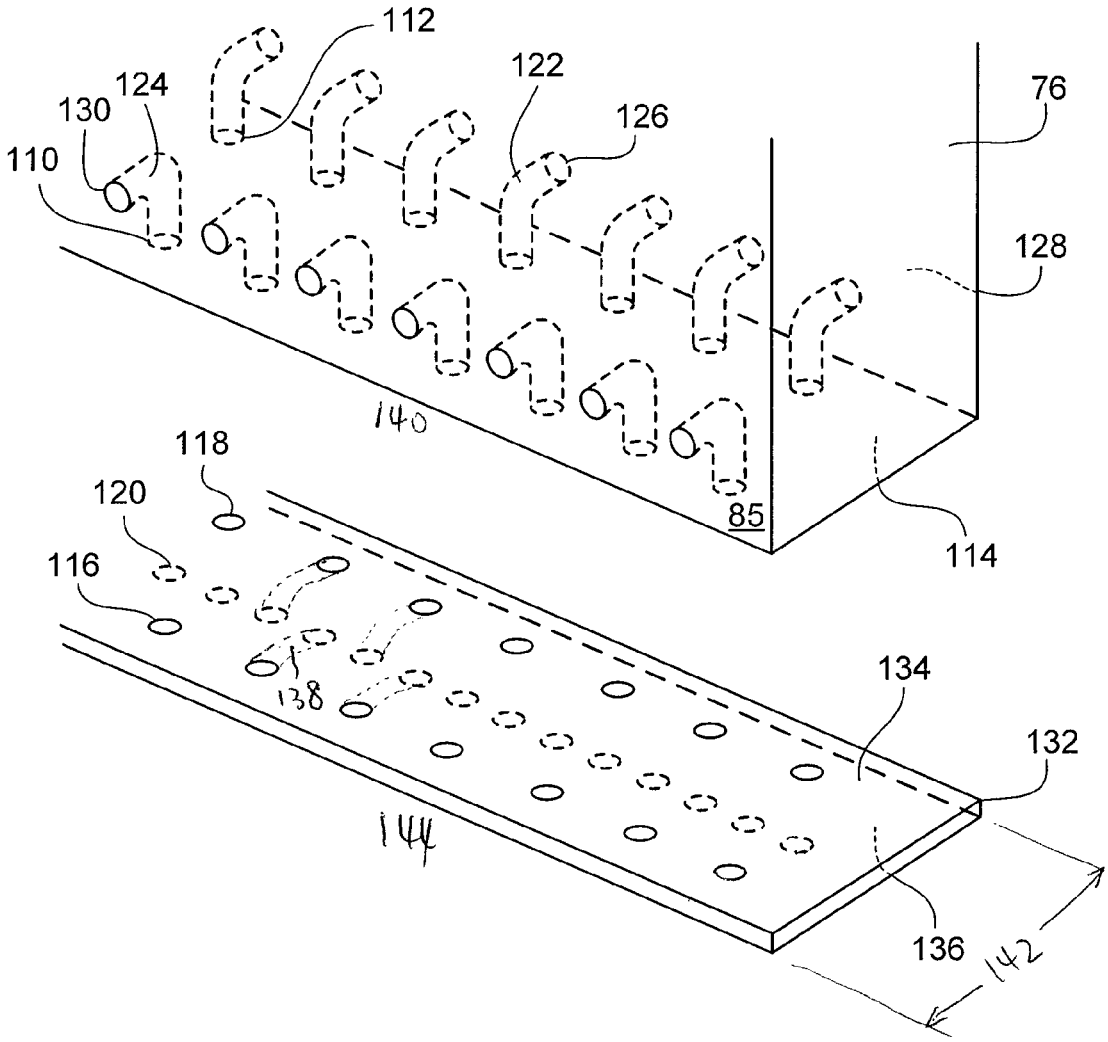

FIG. 4A is an exploded perspective view of a portion of a body of an ink jetting assembly and an orifice plate (not to scale).

Figure 4C:
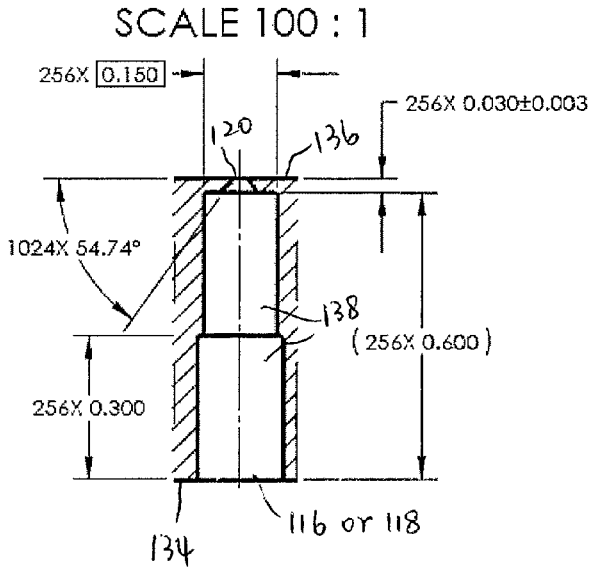
Figure 4B:
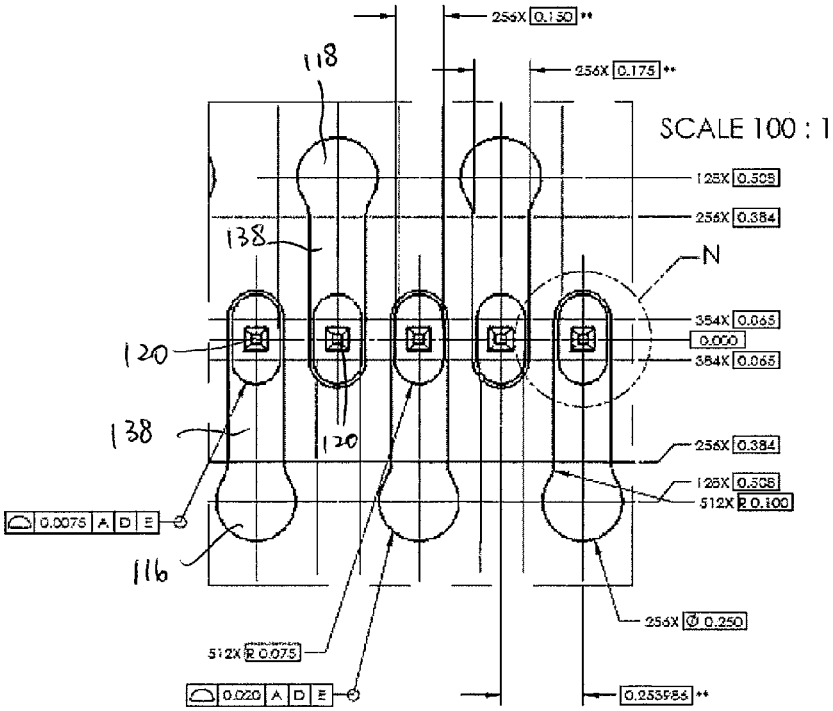

FIGS. 4B and 4C are an enlarged top view of channels within an orifice plate to scale and an enlarged cross-sectional side view of a channel to scale.

Figure 5A:
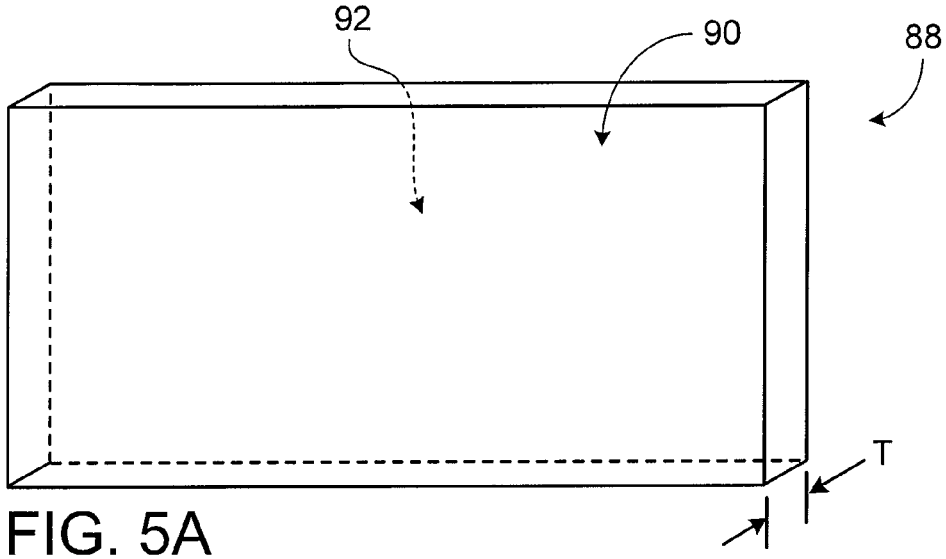
Figure 5B:
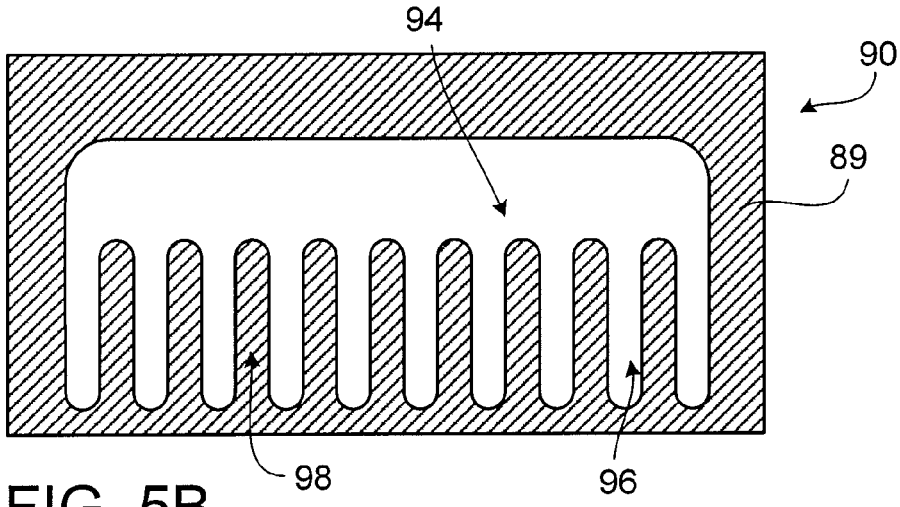
Figure 5C:
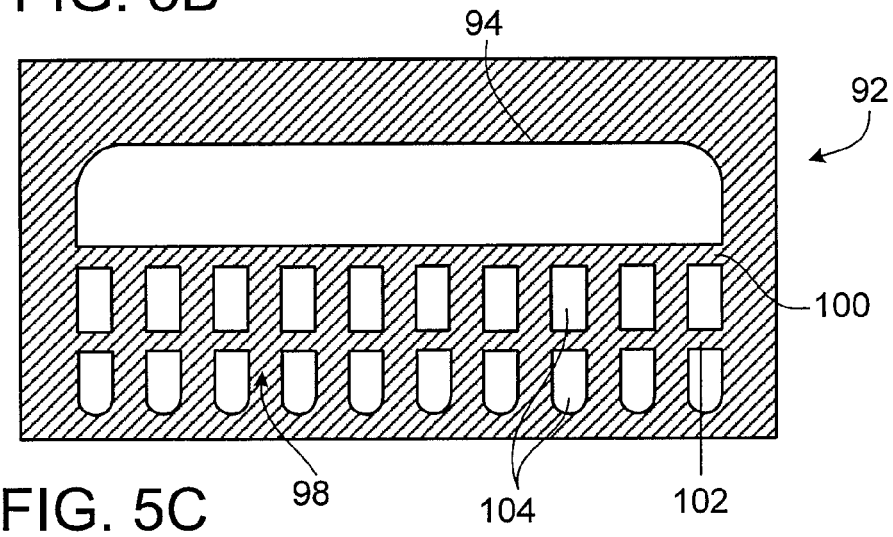

FIGS. 5A-5C show a way to make a cavity plate (not to scale).

Figure 1B:
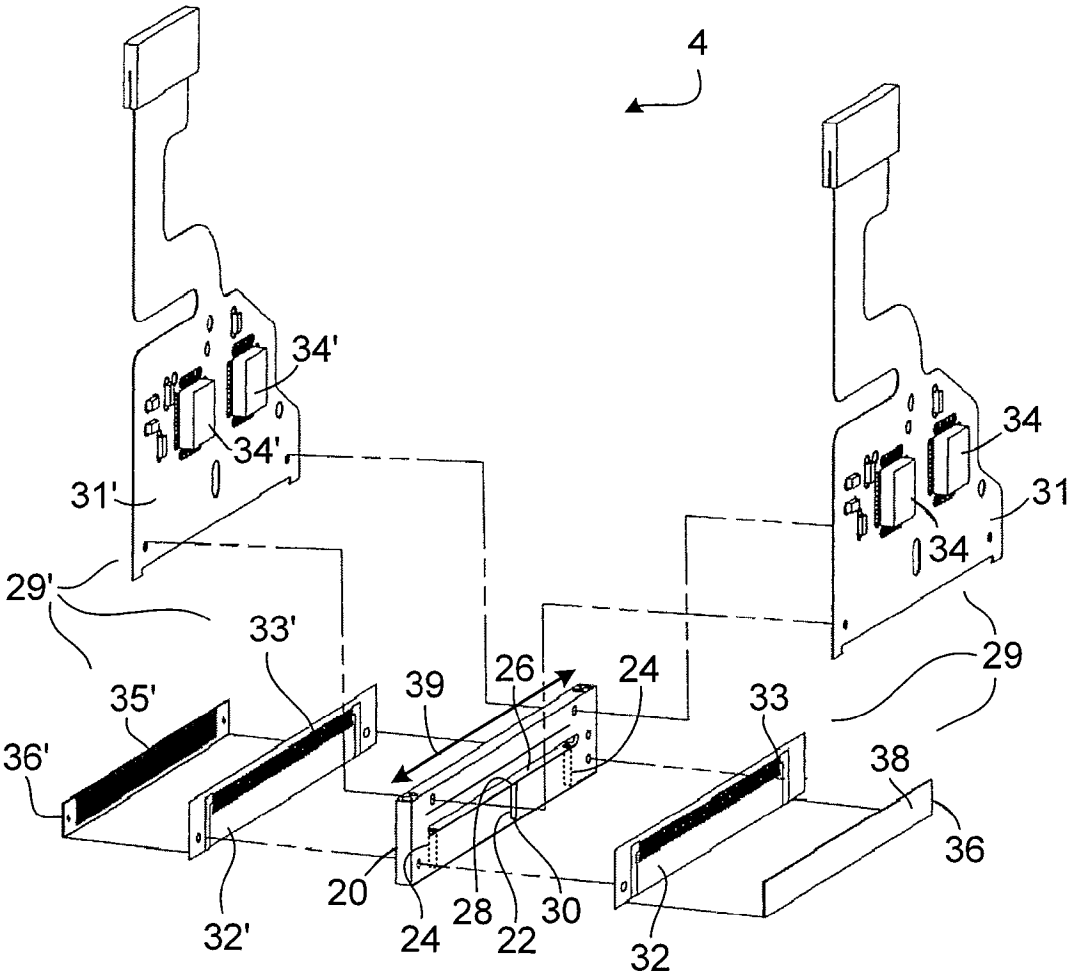
FIGS. 1B and 1C are exploded perspective views an ink jetting assembly (not to scale).
Figure 1A:
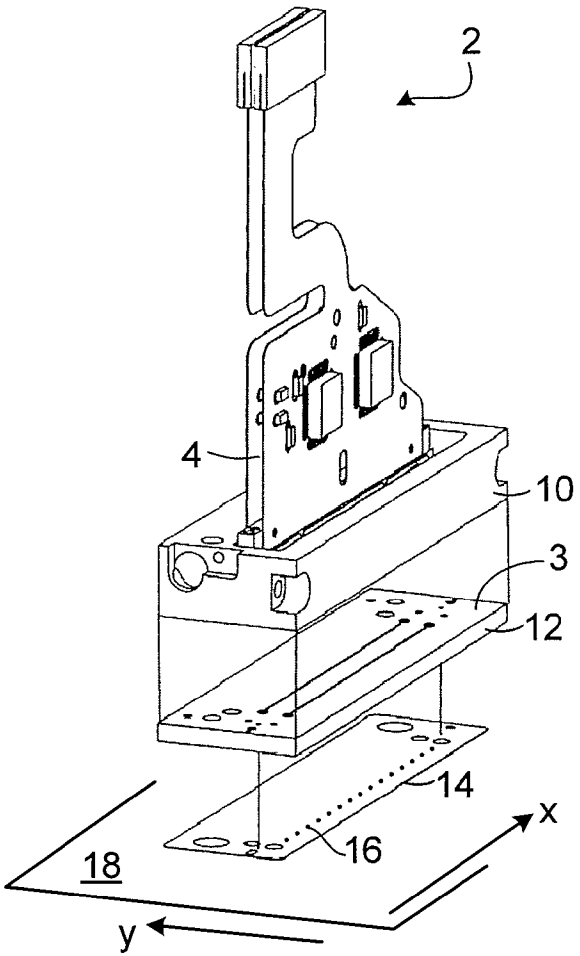
FIG. 1A is an exploded perspective view of an ink jet printing device (not to scale).

Referring to FIG. 1A, for example, a cavity plate can form a part of an ink jet printing device 2 that includes a jetting assembly 4 coupled to a collar 10. The collar 10 is attached to a manifold plate 12, which is attached to an orifice plate 14 having orifices 16. When the ink jet printing device 2 is in use, ink is loaded into the jetting assembly 4 through the collar element 10 and jetted through orifices 16 to form images on a substrate 18.

Referring to FIG. 1B, the ink jetting assembly 4 includes a body 20 on both surfaces of which a stiffener plate and a cavity plate (FIG. 1C) that includes elongated cavities are mounted. A row of wells 22 (not all shown) are formed on each surface of the body 20 by the elongated cavities having their bottoms covered by the stiffener plate. When having the tops covered by the polymer films 32 and 32', the wells 22 form pumping chambers. The details of the stiffener plate and the cavity plate are discussed in FIG. 1C below. In use, ink is filled into the body from upper surface 3 of the manifold plate 12 that contacts the bottom (not shown) of the body 20 through ink passages 24 up into the ink fill passage 26, further down into the pumping chambers through ink inlets 28, and out through the ink outlet ends 30 to the stiffener plate 46 and back to the body 20 to be jetted out of a row of openings (not shown) at the bottom of the body 20.

Figure 1C:
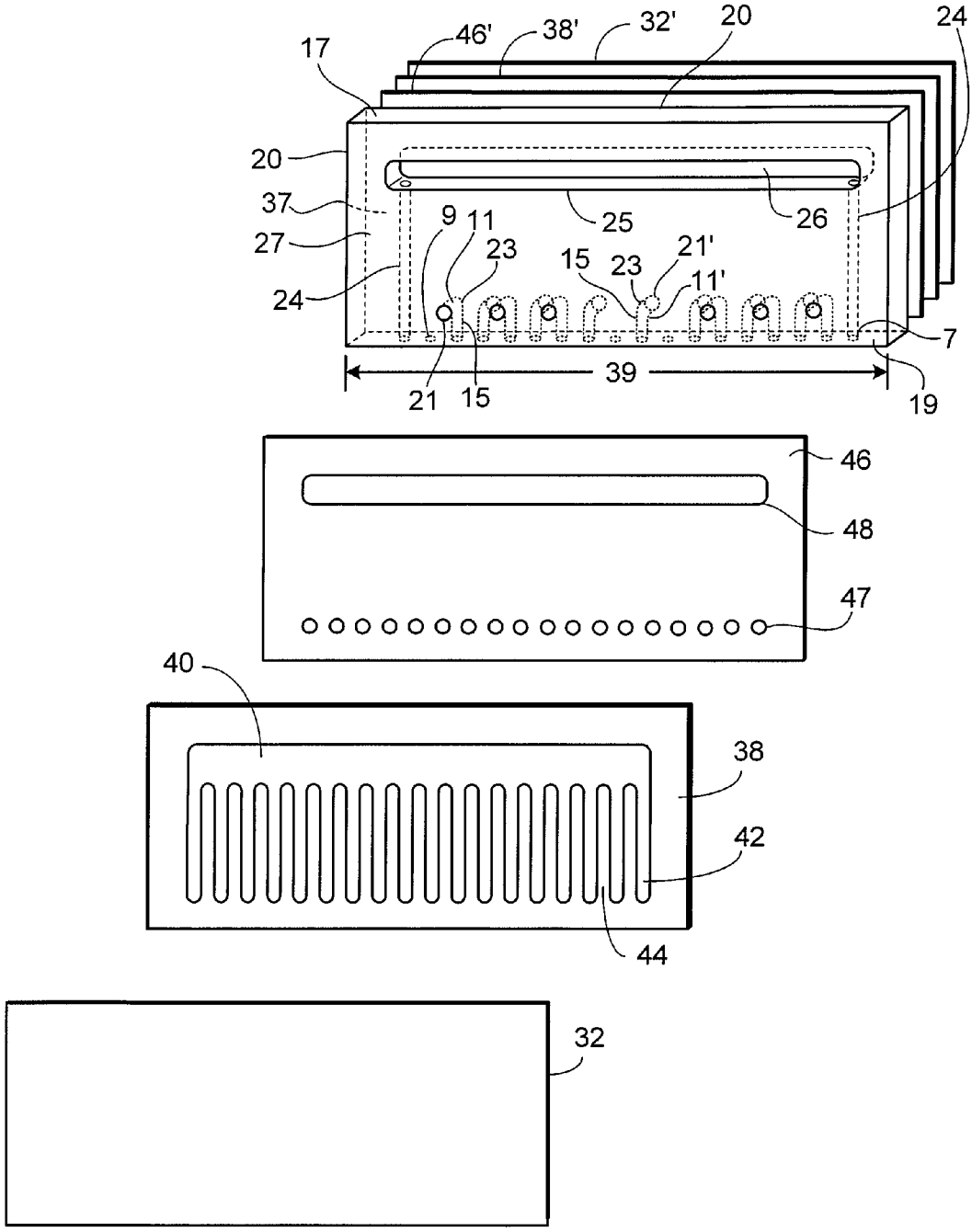

Referring to FIG. 1C, a cavity plate 38 and a cavity plate 38' that have the same dimensions and designs each is overlaid between a size-matching stiffener plate 46 or 46' and size-matching a polymer film 32 or 32'. The cavity plate 38 includes elongated parallel cavities 42 each of which opens at one end into a cavity 40. Each pair of adjacent elongated cavities 42 are separated by an elongated land 44. The dimensions of the cavity 40 and its relative location with respect to the cavity plate 38 matches those of the ink fill passage 26 in the body 20. The stiffener plate 46 includes an upper cavity 48 that matches the cavity 40 and the ink fill passage 26 and a lower row of cavities 47, each of which matches the closed end 30 of a corresponding cavity 42. When assembled and in use, ink reaching the ends 30 of the pumping chambers flow horizontally through the cavity 47 of the stiffener plate 46 back into the body 20.

The body 20 is made, for example, of sintered carbon, and includes a front surface 27 and a back surface 37. One or more, for example two built-in ink passages 24 each has an opening 7 opens to a bottom surface 19 of the body 20 and connected to a built-in ink fill passage 26, which is in the form of an elongated cavity having its length 25 parallel to a length 39 of the body 20. The top and bottom of the cavity 26 are in the front and back surfaces 27 and 37 of the body 20, respectively. The body 20 also includes a row of ink jetting passages 23 (not all shown) along its length 39. Each ink jetting passage 23 includes a horizontal portion 11 having an opening 21 or 21' open to the front or back surface of the body 20, the size and location of the openings matching the cavity 47 of the stiffener plate 46 or 46', and a vertical portion 15 having an opening 9 open to the bottom surface 19 of the body 20 and corresponds to one orifice 16 located beneath. The ink jetting passages 23 having openings 21' to the front surface 27 of the body 20 are alternatively arranged relative to the ink jetting passages 23 that have openings 21 to the back surface 37 of the body 20. The openings 9 are aligned in a row parallel to the length 39 of the body 20 and have a density that is two times the density of pumping chambers formed by each of the cavity plates 38 and 38'. Generally, each pumping chamber, together with its corresponding ink jetting passage 23 and connected openings 21 and 9 and the corresponding orifice 16 are called a jet.

When the overlaid cavity plates 38 and 38' are mounted on the front and back surfaces 27 and 37 of the body 20 and the jetting assembly 4 is in use, ink flows from the body 20 through the pumping chambers and passes ink jetting passages 23 and is jetted from the openings 9 through the orifices 16 onto the substrate 18 (FIG. 1A).

Referring back to FIG. 1B, the jetting assembly 4 also includes electronic components 29 to trigger the pumping chambers formed from the cavities 42 to jet ink. For example, the electronic components include two sets of electrodes 33 and 33' on the polymer films 32 and 32', which are connected by leads (not shown) to respective flexible printed circuits 31, 31' to integrated circuits 34 and 34'. Piezoelectric elements 36 and 36' are attached to the outer side of each of the polymer films 32 and 32' to cover the formed pumping chambers, respectively and each includes a set of electrodes 35 and 35' that contacts the polymer films 32 and 32'.

In use, pulse voltages sent from the integrated circuits 34 and 34' cause the piezoelectric elements 36 and 36' to change their shapes to apply pressures to selected pumping chambers 22. More information about the ink jet module 2 is also provided in U.S. Ser. No. 09/749,893, filed Dec. 29, 2000, and incorporated here by reference.

Referring back to FIG. 1A, in use, the jetting assembly 4 is arranged to have its length 39 (also in FIGS. 1B and 1C) aligned across the substrate 18 along the x direction, for example, perpendicular to the process direction y.

In some embodiments, two jetting assemblies 4 as described above are assembled into each collar 10. Each jetting assembly 4 includes, for example, more than 100, e.g., 128 jets and a row of openings 9 at the bottom of the body 20, where ink is jetted out. Ink from the two rows of openings 9 is re-directed in the manifold plate 12 and passes the single row of orifices 16 on the orifice plate 14 onto the substrate 18.

In some embodiments, the jetting assembly 4 is used without the collar 10 and the manifold 12. The orifice plate 14 is attached to the bottom of the body 20, with the orifices 16 aligned with the openings 9 of the body 20. The surface that is contacting the bottom of the body 20 acts similarly to the surface 3 of the manifold plate 3 to fill ink through the ink passages 24 into the ink fill passage 26 and ink jetted out of the openings 9 passes directly the orifices 16 to reach the substrate 18.

When the jetting assembly 4 is used in what is called a single-pass printer, the ink jet printing device 2 is kept stationary and prints on the substrate 18 that is moving beneath along the y direction. Production of a high resolution image (expressed as a number of dots or pixels per inch (dpi) of substrate) along the x direction can be done faster when the jets in the jetting assembly 4 has a higher density along the length 39. Achievement of such high density jets in a similar sized jetting assembly requires a relatively smaller pitch between adjacent pumping chambers 22 (and cavities in the cavity plate) (FIG. 1B) and therefore narrower lands 44 between the cavities 42.

Referring to FIG. 2, a cavity plate 50 includes a row of identical elongated parallel cavities 52 connected to a cavity 54. Each of the cavities 52 is formed by two long parallel side walls 53, 55, each of which is perpendicular to the top and bottom surfaces 70 and 72 of the cavity plate 50, a curved end wall 61 that is also perpendicular to the surfaces 70 and 72, and an open end 62 connecting the cavities 52 to the cavity 54.

Each pair of adjacent cavities 52 is separated by an elongated land 56. Each land 56 is connected to each adjacent land by two structural supports 58 and 60. As discussed above, when the cavity plate 50 is assembled with its covers, for example, the polymer film 32 or 32' and the stiffener plate 46 or 46' of FIG. 1C, the cavities 52 form pumping chambers and the cavity 54 forms an ink fill passage. During jetting, ink is delivered from the ink fill passage to the pumping chambers through the open end 62 and is pumped from the end of the pumping chamber horizontally back to the body 20 and jetted out (FIG. 1) as described above.

Referring to FIG. 2A, each of the cavities 52 includes the first, open end 62 open to the cavity 54 to receive ink for jetting, and a second, outlet end 64 that is vertically closed and horizontally connected to cavities of the stiffener plates 46 and 46' in the way described above.

In the particular example shown in the figures, the structural supports 58 and 60 are arranged in two parallel rows 69, 71, both upstream of the outlet ends 64 of the cavities 52 and both parallel to an edge 66 of the plate. The row of supports 69 is between (for example, midway between) the upstream ends 62 and the downstream ends 64 of the cavities 52. In some examples, the structural supports 58 between different pairs of adjacent lands are located at different locations (that is, not all in a common row 69) between the upstream ends 62 and the downstream ends 64 of each cavity 52.

In the example shown in the figures, the row 71 is located at the upstream ends 62. In some embodiments, each of the structural supports 58 and 60 is perpendicular to the elongated lands 56 to which it connects. In some implementations, one or more of the structural supports 58 and 60 forms a non-normal angle to the elongated land 56.

Between each pair of adjacent lands 56, the cavity plate 50 may include only one structural support 58 in row 69, or there may be more than one row 69. In row 71, there may be only one set of support 60 or more than one.

Other arrangements are possible, in which either, but not both of the supports 58 and 60 is provided between each pair of adjacent lands 56.

The cavity plate 50 may be formed of a metal for example, titanium, or metal alloy, for example, nickel-cobalt ferrous alloy (e.g., Kovar, Carpenter Technology Coorporation) or stainless steel. In some examples, each of the elongated parallel cavities 52 has a length L, for example, of about 3.7 mm to about 10 mm. Each of the cavity 52 also has a width $w_c$ (FIG. 2B), for example, of about 380 microns to about 750 microns, and each of the lands 56 has a width $w_l$ (FIG. 2B), for example, of less than about 300 microns, 290 microns, 280 microns, 270 microns, 260 microns, or 250 microns, and/or greater than about 110 microns, 120 microns, 130 microns, 140 microns, or 150 microns. In some embodiments, the cavities 52 on the cavity plate 50 can have a linear density along the x axis as shown in FIGS. 2A and 2B, of at least 25, 30, 35, 40, 45, or 50 cavities per inch. The jetting assemblies that include the cavity plate 50 having cavities and lands of the above dimensions can produce images at a resolution, for example, of at least 300 dpi, 600 dpi, or 1200 dpi.

The structural support 58 or 60 has a width d, for example, of about 100 microns to about 150 microns, for example, 102 microns. The structural supports 58 or 60 also has a thickness t that is less than the depth D of the cavities 52 (FIG. 2B). For example, the thickness t of the structural supports 58 or 60 is less than, e.g., about 80%, 70%, 60%, 50%, 40%, or 30%, and/or greater than, e.g., about 5%, 10%, 15%, or 20%, of the depth D of the cavities 52. In some embodiments, the depth D of the cavities 52 is about 75 microns to about 150 microns.

The structural supports 58 and 60 strengthen the cavity plate 50 and support the lands 56 especially from the time when the cavity plate 50 is fabricated (and the lands, because they are narrow and thin, are fragile and vulnerable to bending, folding, or breaking) until the covers are mounted on the cavity plate 50 and can then provide additional support. The jetting assembly that includes the cavity plate 50 can therefore have a higher nozzle pitch and produce high resolution images.

Referring to FIG. 2B (which is a view toward the ends 64 of the cavities 52 from the openings 62), each cavity 52 has two parallel front and back surfaces 70 and 72. The supports 58 or 60 have a surface 68 that is in the same plane as one of the front and back faces 70 and 72. In some implementations, the surfaces 68 can be in a different plane from either of the front and back faces 70 and 72.

A top view of the cavity plate 50 is shown to scale in FIG. 3A. A portion of the cavity plate 50 that includes the cavities 52, the lands 56, and the structural supports 58 and 60 is shown enlarged to scale in FIG. 3B.

By mounting polymer films 32 and 32' and stiffener plates 46 and 46' (FIGS. 1B and 1C) on the two opposite surfaces 70 and 72 of the cavity plate 50 of FIGS. 2, 2A, and 2B, the pumping chambers and the ink fill passage 26 are formed to produce an ink jetting assembly body 20 (FIG. 1B). In some embodiments, the polymer films 32 and 32' are made, for example, of polyimide (e.g., Kapton, E. I. du Pont de Nemours and Company). The compliant polymer films 32 and 32' allows the change of shape or deflection of the piezoelectric elements 36 and 36' (FIG. 1B) to be delivered to the ink within the pumping chambers to jet ink and the stiffener plates 46 and 46' stiffen and support the formed pumping chambers.

Referring to FIG. 4, the cavity plate 50 can also be used in a silicon based jetting assembly 74. The jetting assembly 74 includes a body 76 made, for example, of sintered carbon or silicon and having two ink passages 80 and 80' each connected to and delivers ink to an ink fill passage 82, which is in the form of an elongated cavity similar to the ink fill passage 26 of FIGS. 1B and 1C. The body 76 also includes rows of openings and ink jetting passages similar to the openings 9, 21 and the ink jetting passages 23 of FIG. 1C for ink jetting. The cavity plate 50 is overlaid by a stiffener plate 84 having the same property as the stiffener plate 46 or 46' of FIG. 1C and a polymer film 86 similar to the polymer film 32 or 32' of FIGS. 1B and 1C. A piezoelectric element 83 having the same properties as the piezoelectric element 36 or 36' of FIG. 1B is mounted on the other surface of the polymer film 86. An assembled set 81 that includes the stiffener plate 84, the cavity plate 50, the polymer film 86, and the piezoelectric element 83 is mounted on the front side 85 and the back side (not shown) of the body 76, with the other surface of the stiffener plate 84 contacting the body 76. The jetting assembly 74 also includes a printed circuit board 78 connected to the body 76. The printed circuit board 78 includes integrated circuits 87 in connection with the electrodes on the piezoelectric element 83 and the polymer film 86 to activate the piezoelectric element 83 as described for the jetting assembly 4.

Referring to FIG. 4A, each jetting assembly 74 can include, for example, more than 200, e.g., 256 jets and two rows, for example, parallel rows of openings 110 and 112 (not all shown) on a bottom surface 114 of the body 76. Each opening in the row 112 is connected to an ink jetting passage 122 similar to the ink jetting passages 23 of FIG. 1C with an opening 126 open to a back surface 128 of the body 76. Similarly, each opening in the row 110 is connected to an ink jetting passage 124 with an opening 130 on the surface 85. The openings 112 are, for example, equal distanced and staggered with respect to the openings 110, which can also be equal distanced, along a long dimension 140 of the body 76.

In some embodiments, an orifice plate 132, made, for example, of silicon, by, for example, etching, is attached to the bottom surface 114 of the body 76. The orifice plate 132 includes two rows, for example, parallel rows of openings 116 and 118 (not all shown) in an upper surface 134 to align with the opening rows 110 and 112 of the body 76. The openings 116 are, for example, equal distanced and staggered with respect to the openings 118, which can also be equal distanced, along a long dimension 144 of the orifice plate 132. Channels 138 (not all shown) are built within the orifice plate 132 to direct ink jetted out of the openings 110 and 112 through the orifice plate 132 and out from a single row of openings 120 (not all shown) in a lower surface 136. In some embodiments, each opening 120 is square shaped orifice and has a size smaller than the size of an opening in the rows 116 and 118. Each channel 138 tapers from each of the openings 110 and 118 towards the corresponding opening 120. When projected onto the same plane, along the long dimension 144, the openings 120 are alternatively aligned with openings 116 and 118 along a wide dimension 142 of the orifice plate. The openings 120 are, for example, equal distanced from each other, and the total number of the openings 120 is, for example, the sum of the total number of openings 116 and 118.

A top view of the channels 138 within the orifice plate 132 is shown to scale in FIG. 4B. A cross-sectional side view of a channel 138 is shown to scale in FIG. 4C.

In some embodiments, one or more jetting assemblies 74 can be assembled into the collar 10 of FIG. 1A and functions similarly to the jetting assemblies 4.

Referring to FIGS. 5A and 5B, to make the cavity plate, an etch-resistant pattern 89 is formed on a front surface 90 of the metal plate 88 to define the cavities 52 and 54 and the lands 56 to be formed. For example, the un-shaded region 94 delineates the cavity 54 to be formed, the un-shaded regions 96 delineate the cavities 52 to be formed, and the shaded regions 98 delineate the lands 56 to be formed.

Referring to FIG. 5C, an etch-resistant pattern of the cavities 52 and 54, the lands 56, and the structural supports 58 and 60 is marked on a back surface 92 of the plate 88. Compared to the pattern formed on the front surface 90, the additional regions 100 and 102 within the un-shaded regions 96 (FIG. 4B) indicate where the structural supports 58 and 60 are to be formed. The remaining unpatterned portions of the region 96 are regions 104.

To form the cavity plate, the plate 88 bearing the patterned front surface 90 and the patterned back surface 92 is then etched in an etching solution. In some embodiments, an echant is sprayed onto the hanging plate 88 from both surfaces 90 and 92, for example, simultaneously.

In some embodiments, the plate 88 is etched long enough to form the cavities in the regions 94 and 104, and the structural supports in the regions 100 and 102. During etching, both the front surface 90 and the back surface 92 of the plate 88 are in contact with the etching solution. The plate material in regions 94 and 104 is etched from both surfaces 90 and 92 toward the center of the plate 88, while the plate material in regions 100 and 102 is etched only from the front surface 90. By the time when the plate material in regions 94 and 104 is etched completely through to form the cavities, the plate material in regions 100 and 102 has not been etched completely through. By continuing to etch the plate, it is possible to impart to the structural supports a desired thickness within some range. Once that thickness is reached, etching is stopped, and the etch-resistant pattern is removed.

Information about jetting assemblies and ink jetting devices is also provided, for example, in U.S. Ser. No. 09/749, 893, filed Dec. 29, 2000, and incorporated here by reference.

Other embodiments are also within the scope of the following claims.

For example, the structural supports need not lie at either surface of the cavity plate, but can be partly or wholly above the surface, or may lie below the surface within the cavity with spaces above and below them as long as the flow of ink along the cavities is not entirely obstructed. The cavity plate 50 can also be machined by numerically controlled machining techniques or be etched by other techniques from a silicon substrate. The body 74 can include only one single row of openings on its bottom surface 114, each opening connected to an ink jetting passage similar to that is described in FIG. 1C. The jetting assembly 4 or 74 can be arranged to have its length aligned across the substrate 18 along the x direction forming an angle other than 90 degrees with the process direction y.

When there is little or no jetting in the jetting assembly 4 or 74, ink recirculation can be done by letting ink flow slowly in one of the two ink inlets 24 or 80 and 80' through the ink passage 26 or 82 and out the other one of the ink inlets 24 or 80 and 80'.

It should be understood that reference to ink as the printing fluid was for illustrative purposes only, and referring to components within the jetting assemblies described above with the adjective "ink" was also illustrative. The jetting assemblies can be used to dispense or deposit various printing fluids other than ink onto a substrate. The fluids can include non-image forming fluids. For example, three-dimensional model pastes can be selectively deposited to build models. Biological samples can be deposited on an analysis array.

What is claimed is:

1. A cavity plate for use in ink jetting comprising an ink outlet end;

elongated lands each of which extends from the ink outlet end toward an ink inlet end of the cavity plate, the elongated lands having side walls between top and bottom surfaces of the cavity plate to form elongated cavities that are open at both the top and bottom surfaces of the cavity plate, and structural supports upstream of the ink outlet end and connecting at least some of the elongated lands, to support the elongated lands.

2. The cavity plate of claim 1 in which the structural supports that connect at least some of the elongated lands are located downstream of the ink inlet end of the cavity plate.

3. The cavity plate of claim 1 in which the structural supports that connect at least some of the elongated lands are located at the ink inlet end.

4. The cavity plate of claim 1 in which at least some of the structural supports that connect at least some of the elongated lands are located at the ink inlet end of the cavity plate and at least some of the structural supports that connect at least some of the elongated lands are located downstream of the ink inlet end.

5. The cavity plate of claim 1 in which the structural supports that connect at least some of the elongated lands are located midway between the ink inlet end and the ink outlet end.

6. The cavity plate of claim 1 in which each of the structural supports connects one land to an adjacent land.

7. The cavity plate of claim 1 in which each cavity has a depth between the top and bottom surfaces, and each of the structural supports has a thickness less than the depth of the cavity.

8. The cavity plate of claim 1 in which each cavity has a depth between the top and bottom surfaces, and each of the structural supports has a thickness less than half of the depth of the cavity.

9. The cavity plate of claim 1 in which each of the structural supports has a surface in the same plane as one surface of the cavity plate.

10. The cavity plate of claim 1 in which the structural supports are perpendicular to the lands.

11. The cavity plate of claim 1 in which the side walls are formed by etching.

12. The cavity plate of claim 1 in which the structural supports are integral with the lands.

13. The cavity plate of claim 1 also including covers on the top and bottom surfaces to enclose the cavities to form pumping chambers.

14. The cavity plate of claim 1 also including piezoelectric elements positioned to pump ink from the cavities through the ink outlet end.

15. A method for making a cavity plate for use in ink jetting, the method comprising:

forming, as part of the plate, elongated lands, elongated cavities between the lands, and structural supports;

the elongated lands having side walls between top and bottom surfaces of the cavity plate to form the elongated cavities that are open at both the top and bottom surfaces of the cavity plate, the elongated cavities each including an ink outlet end, and the structural supports connecting at least some of the elongated lands upstream of the ink outlet end to support the elongated lands.

16. The method of claim 15 in which the forming comprises etching.

17. The method of claim 16 in which the etching is done differently at the locations of the structural supports from the etching done at other locations of the cavity plate.

18. The method of claim 17 in which the etching is done differently by etching from only one surface of the plate at the locations of the structural supports and from both surfaces of the plate at the other locations.

19. The method of claim 15 further comprising attaching covers to each surface of the cavity plate to form pumping chambers.

20. The method of claim 19 in which the covers comprise polymer films.

21. The method of claim 19 in which the covers comprise stiffener plates.

* * * * *

UNITED STATES PATENT AND TRADEMARK OFFICE

CERTIFICATE OF CORRECTION

PATENT NO. : 8,091,988 B2
APPLICATION NO. : 12/125648
DATED : January 10, 2012
INVENTOR(S) : McDonald It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 220 days.

Signed and Sealed this
Twenty-ninth Day of May, 2012

David J. Kappos

David J. Kappos
*Director of the United States Patent and Trademark Office*